US006989747B2

(12) United States Patent
Konecnik

(10) Patent No.: US 6,989,747 B2
(45) Date of Patent: Jan. 24, 2006

(54) ARRANGEMENT AND METHOD FOR DETECTING UNAUTHORIZED REMOVAL OF ELECTRONIC EQUIPMENT

(76) Inventor: Ernst Konecnik, Lasarettsvagen 7, 131 45 Nacka (SE)

( * ) Notice: Subject to any disclaimer, the term of this patent is extended or adjusted under 35 U.S.C. 154(b) by 120 days.

(21) Appl. No.: 10/659,151

(22) Filed: Sep. 10, 2003

(65) Prior Publication Data

US 2005/0088317 A1 Apr. 28, 2005

(51) Int. Cl.
*G08B 13/12* (2006.01)

(52) U.S. Cl. ..... 340/568.2; 340/568.3

(58) Field of Classification Search ... 340/568.2–568.4
See application file for complete search history.

(56) References Cited

U.S. PATENT DOCUMENTS

| | | | | |
|---|---|---|---|---|
| 3,633,199 A | * | 1/1972 | Curry et al. | 340/538 |
| 4,040,045 A | * | 8/1977 | Osborne et al. | 340/537 |
| 4,736,195 A | * | 4/1988 | McMurtry et al. | 340/568.3 |
| 5,231,375 A | * | 7/1993 | Sanders et al. | 340/568.2 |
| 5,243,328 A | * | 9/1993 | Lee et al. | 340/568.3 |
| 5,406,260 A | * | 4/1995 | Cummings et al. | 340/568.2 |
| 5,543,782 A | * | 8/1996 | Rothbaum et al. | 340/568.2 |
| 6,650,622 B1 | * | 11/2003 | Austerman et al. | 370/241 |

FOREIGN PATENT DOCUMENTS

| | | | |
|---|---|---|---|
| DE | 34 22 845 | | 1/1985 |
| GB | 2158277 A | * | 11/1985 |
| GB | 2 274 532 | | 7/1994 |

OTHER PUBLICATIONS

Mitchell and Corton, Continuous security alarm for electronic equipment, DERWENT-ACC-NO: 1985-278510.*

* cited by examiner

*Primary Examiner*—Jeffery Hofsass
*Assistant Examiner*—Anne V. Lai
(74) *Attorney, Agent, or Firm*—Rolf Fasth; Fasth Law Offices

(57) ABSTRACT

The present invention relates to an arrangement and a method for detecting unauthorized removed of electronic equipment. The arrangement is arranged between a power source and the electronic equipment and includes a first current recognizing element. The detection of unauthorized removal is obtained by sensing a level of the current that flow to the electronic equipment. Furthermore, a signal is sent to the electronic equipment so that the signal is adapted to bounce back to the arrangement. The detection of unauthorized removal is obtained when the current sensed is lower than a predetermined value and the bounced back signal is absent.

4 Claims, 1 Drawing Sheet

ARRANGEMENT AND METHOD FOR DETECTING UNAUTHORIZED REMOVAL OF ELECTRONIC EQUIPMENT

PRIOR APPLICATIONS

This is a US patent application that claims priority from Swedish Patent Application No. 0203884-2, filed 23 Dec. 2002.

TECHNICAL FIELD

The present invention relates to an arrangement and a method for detecting unauthorized removal of electronic equipment that is connected to a power source. The arrangement is arranged between the power source and the electronic equipment and includes a first current recognizing element. The detection of the unauthorized removal is obtained by sensing the level of current that flows to the electronic equipment.

FIELD OF THE INVENTION

Today's stores and public premises use more and more audio-visual means for conveying their messages. The audio-visual means may for example be plasma screens and large picture projectors. A problem is that this type of products is very desirable to steal since they are valuable and can easily be sold to receivers of stolen goods. The spontaneous stealing of screens and similar products in public premises is a growing problem. For example, nobody notices if a false service technician removes a projector in a public area and walks away with the projector.

There are many different alarm systems that prevent this type of theft. A common system is a cable, or another signal equipment, that is pulled through the equipment to be protected. An existing opening, such as at a fan, is often used where it is possible to insert the cable and pull out the cable to create a loop that triggers an alarm when cut. This type of alarm system has many drawbacks such as the loop may be attached to, for example, a plastic piece that may be broken or cut so that the equipment may be removed without cutting the loop and the alarm is not triggered. Further, this type of alarm may be by-passed by a conductor that takes over the function of the loop when the loop is cut so that the system senses the intact loop and the alarm is not triggered.

Other alarm systems exist such a metal plates that senses that the contact of the equipment is still connected to the wall or special devices that are mounted in the equipment to be protected.

Some systems sense the current that is delivered to the protected equipment and sends an alarm when this current is too low. One problem with these systems is that they do not function in case of a power outage.

SUMMARY OF THE INVENTION

The present invention relates to an arrangement and a method for detecting unauthorized removal of electronic equipment that solves the above-mentioned problems. The arrangement is arranged between a power source and the electronic equipment and includes a first current recognizing element. The detection of unauthorized removal is obtained by sensing a level of the current that flows to the electronic equipment. The arrangement of the present invention further sends a signal to the electronic equipment so that the signal is adapted to bounce back to the arrangement. The detection of unauthorized removal is obtained when the following conditions are met; the current sensed is lower than a predetermined value and the bounced back signal is absent. In this way, the advantage is obtained that the alarm will not be triggered in case of a power outage, when the current is thus zero, as long as the apparatus is connected and the bounced signal can be detected.

In a preferred embodiment, the arrangement has an alarm unit arranged to send an alarm signal to an alarm center when the detection of unauthorized removal is obtained.

In a further embodiment, the arrangement includes a second current recognizing element that senses the current delivered from the power source. In this embodiment, the bouncing signal is sent to the electronic equipment when the current sensed by a second current recognizing element is lower than a predetermined value.

In a preferred embodiment, the arrangement includes a unit that sends a signal to the electronic equipment. In case of power outage, the unit is transferred to operate via the batteries. In this way, the removal of the protected equipment is detected even during a power outage. The batteries are dimensioned to handle continuous operation for 24 h and the alarm for at least 5 h when there is a power outage. The lifetime of the batteries is about 5–6 years. When the battery level is reduced below a level, this is indicated so that the batteries can be replaced. During continuous normal operation the batteries are charged.

In a preferred embodiment, the arrangement further includes a unit that is connected to the audio-contact of the electronic equipment. The unit is arranged to sense a resistance that has a predetermined value and a signal is sent to an alarm unit when the resistance is different from this value.

DETAILED DESCRIPTION OF PREFERRED EMBODIMENTS

Figure 1:
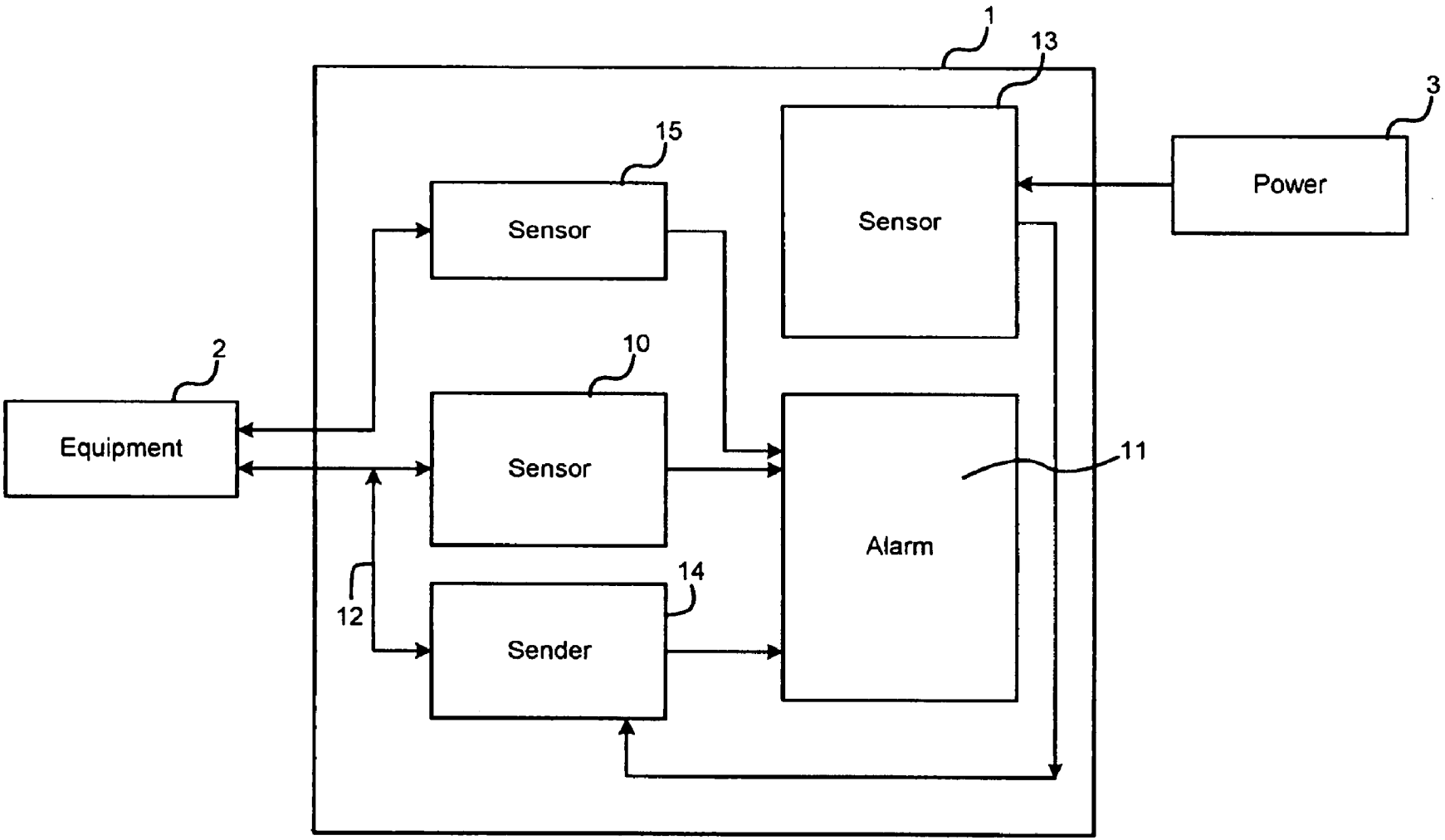
FIG. 1 shows a preferred embodiment of the present invention.

The present invention is now described in detail with reference to the attached figure.

FIG. 1 shows a block diagram of the preferred embodiment of the arrangement according to the present invention. The arrangement 1 is connected between the item that is desired to be protected 2 and the power source 3. The arrangement includes a first current recognizing element 10 that senses the current that is delivered to the equipment. When the first current recognizing element 10 indicates that the level of current towards the equipments is lower than a predetermined value, that varies depending upon which equipment that is to be protected, a signal is sent to an alarm unit 11. The alarm unit 11 is connected to an alarm center. When the alarm unit 11 alarms a signal is sent to the alarm center. The arrangement 1 also includes a second current recognizing element 13 that senses the current that is delivered from the power source 3. When the second current recognizing element 13 indicates that the current is too low, a signal is triggered to the unit 14 that goes into a so called loop mode and sends a signal at a predefined frequency to the equipment 2. This signal bounces back to the unit 14 when the protected equipment 2 is in place. In the case when the equipment 2 has been removed from its place, the signal sent by the unit 14 will not bounce back and the unit 14 sends a signal to the alarm unit 11 that sends out an alarm.

The unit 14 is equipped with batteries for ensuring it functions during power outages.

The arrangement 1 also includes a unit 15 that is connected to an audio-contact of the equipment 2. The unit 15 senses a resistance 75 Ohm and sends a signal to the alarm unit 11 when the resistance sensed is different from this value.

The invention is not limited to the above illustrative preferred embodiments and can be modified within the scope of the spirit of the invention as described in the appended patent claims.

What is claimed is:

1. A method for detecting unauthorized removal of electronic equipment that is connected to a power source, wherein a current delivered to the electronic equipment is sensed by a first current recognizing unit that is included in an arrangement, the arrangement is arranged between the power source and the electronic equipment, characterized therein that a check signal is sent to a sender unit when the current sensed by the first current recognizing unit is below a predetermined value, the sender unit receiving the check signal, the sender unit sending a bounce back signal to the electronic equipment, the bounce back signal being adapted to bounce back to the arrangement so that a detection of unauthorized removal is obtained and a generation of an alarm signal is triggered when the current sensed by the first current recognizing element is lower than the predetermined value and the bouncing back of the bounce back signal is not received by the sender unit, and a current delivered from the power source is sensed by a second current recognizing element that is included in the arrangement so that the signal is sent from the arrangement to the electronic equipment when a current sensed by the second current recognizing element is lower than a certain predetermined level.

2. The method according to claim 1 wherein an alarm signal is sent from an alarm unit, that is included in the arrangement, to an alarm center when a detection of unauthorized removal is obtained.

3. The method according to claim 2 wherein the unit, included in the arrangement, is connected to an audio-contact of the electronic equipment so that a resistance that has a predetermined value is sensed by the unit so that a signal is sent from the unit to the alarm unit when the resistance is different from this value.

4. The method according to claim 1 wherein the signal is sent from a unit that is included in the arrangement.

* * * * *